United States Patent [19]

Lauchenauer

[11] 3,957,936

[45] May 18, 1976

[54] HIGH TEMPERATURE PROCESS FOR MODIFYING THERMOPLASTIC FILAMENTOUS MATERIAL

[75] Inventor: Alfred E. Lauchenauer, Thurgau, Switzerland

[73] Assignee: Raduner & Co., AG, Horn, Thurgau, Switzerland

[22] Filed: July 22, 1971

[21] Appl. No.: 165,201

[52] U.S. Cl. ..... 264/53; 264/290 N; 264/290 T; 264/343; 264/345; 264/348; 264/DIG. 5; 264/DIG. 13; 428/398

[51] Int. Cl.[2] ..... B29D 27/00

[58] Field of Search ..... 428/376; 428/400; 264/41, 49, 51, 53, 54, DIG. 8, 211, 343, 342 RE, 53, 51, DIG. 9, DIG. 16, 2.5 B, 2.5 AB, 48, 45, 210 F, 345, 348, 343, 290 N, 290 T, DIG. 13, DIG. 5

[56] References Cited

UNITED STATES PATENTS

| | | | |
|---|---|---|---|
| 2,256,483 | 9/1941 | Johnston | 264/49 X |
| 2,302,077 | 11/1942 | Von Kohorn | 428/400 X |
| 2,956,330 | 10/1960 | Pitzl | 264/342 RE UX |
| 3,026,272 | 3/1962 | Rubens et al. | 264/53 X |
| 3,088,188 | 5/1963 | Knudsen | 428/400 X |
| 3,102,323 | 9/1963 | Adams | 264/DIG. 8 |
| 3,117,173 | 1/1964 | Adams | 264/211 X |
| 3,118,161 | 1/1964 | Cramton | 264/DIG. 16 |
| 3,121,132 | 2/1964 | Del Bene | 264/53 X |
| 3,129,273 | 4/1964 | Lowes | 264/DIG. 8 |
| 3,147,321 | 9/1964 | Oswald et al. | 264/53 |
| 3,184,369 | 5/1965 | Haseley | 428/400 X |
| 3,214,234 | 10/1965 | Bottomley | 264/DIG. 16 |
| 3,215,486 | 11/1965 | Hada et al. | 264/DIG. 16 |
| 3,251,728 | 5/1966 | Humbert et al. | 264/51 X |
| 3,262,625 | 7/1966 | Russell et al. | 264/48 X |
| 3,296,019 | 1/1967 | Keller et al. | 117/139.5 CQ X |
| 3,303,045 | 2/1967 | Newman | 264/53 X |
| 3,303,045 | 2/1967 | Newman | 264/53 X |
| 3,320,328 | 5/1967 | Michaels | 264/343 X |
| 3,323,978 | 6/1967 | Rasmussen | 264/DIG. 8 |
| 3,413,797 | 12/1968 | Chapman | 264/342 RE X |
| 3,422,171 | 1/1969 | Oppenlander | 264/54 X |
| 3,441,642 | 4/1969 | Engelman et al. | 264/342 RE X |
| 3,446,734 | 5/1969 | Coats | 117/139.5 CQ X |
| 3,449,477 | 6/1969 | Logomasini | 264/54 X |
| 3,457,340 | 7/1969 | Arnold | 117/139.5 CQ X |
| 3,513,110 | 5/1970 | Noether | 264/290 R X |
| 3,516,239 | 6/1970 | Fukuda et al. | 428/400 X |
| 3,551,538 | 12/1970 | Yamamoto et al. | 264/53 X |
| 3,558,763 | 1/1971 | Quynn et al. | 264/342 RE X |
| 3,592,684 | 7/1971 | Smith | 117/139.5 CQ X |
| 3,671,381 | 6/1972 | Hansen | 428/400 |
| 3,683,610 | 8/1972 | Buzano | 428/400 X |
| 3,723,362 | 3/1973 | Battigelli | 264/DIG. 9 |
| 3,728,072 | 4/1973 | Orito et al. | 428/400 X |
| 3,802,954 | 4/1974 | Orito et al. | 428/400 |

FOREIGN PATENTS OR APPLICATIONS

| | | | |
|---|---|---|---|
| 707,812 | 4/1965 | Canada | 260/2.5 B |
| 916,116 | 8/1954 | Germany | 264/53 |
| 988,290 | 4/1965 | United Kingdom | 260/2.5 B |

OTHER PUBLICATIONS

Naturman, Louis I., "How to Select Blowing Agents for Thermoplastics," In *Plastics Technology*, Oct. 1969, pp. 41–47.

Brydson, J. A. "Plastics Materials" Princeton, N.J., D. Van Nostrand, c1966, pp. 341–349.

Whittington, Lloyd R. "Whittington's Dictionary of Plastics," Stamford, Conn., Technomic, c1968, pp. 18, 221 and 251.

Billmeyer, Fred W. "Textbook of Polymer SCience," Second Edition, New York, Wiley–Interscience, c1971, p. 243.

Baer, Eric, Edt. "Engineering Design for Plastics," New York, Van Nostrand Reinhold, c1964, pp. 404–407, (Polymer Science and Engineering Series).

Miller, M. L. "The Structure of Polymers," SPE New York, Reinhold, c1966, pp. 286–289; 527–534, (SPE Polymer Science and Engineering Series).

"Encyclopedia of Polymer Science and Technology," Vol. 3, New York, Interscience, c1965, pp. 619–621.

"Encyclopedia of Polymer Science and Technology," Vol. 5, New York, Interscience, c1966, pp. 37–57.

*Primary Examiner*—Philip Anderson
*Attorney, Agent, or Firm*—Howson and Howson

[57] ABSTRACT

Filaments having a substantially increased inner surface, in particular porous filaments of filaments having a cracked, notched or nicked surface of thermoplsatic material are produced by subjecting filaments of thermoplastic material, preferably containing a pore-forming agent, to a heating medium at a temperature at least 100°, preferably 150°C. above the glass transition temperature of the thermoplastic material, preferably near or above its softening point, the temperature of the heating medium and the time of exposure of the filaments thereto being such that the peripheral portions of the filaments are affected by the heat treatment to a substantially larger degree than the core portions creating within the filaments temporarily a temperature gradient between the core and periphery of the filaments, the temperature at the periphery being sufficient to reduce the intermolecular cohesion of the thermoplastic material at the periphery, and the action of heat at the core being substantially lower than at the periphery.

16 Claims, 6 Drawing Figures

FIG. 1.
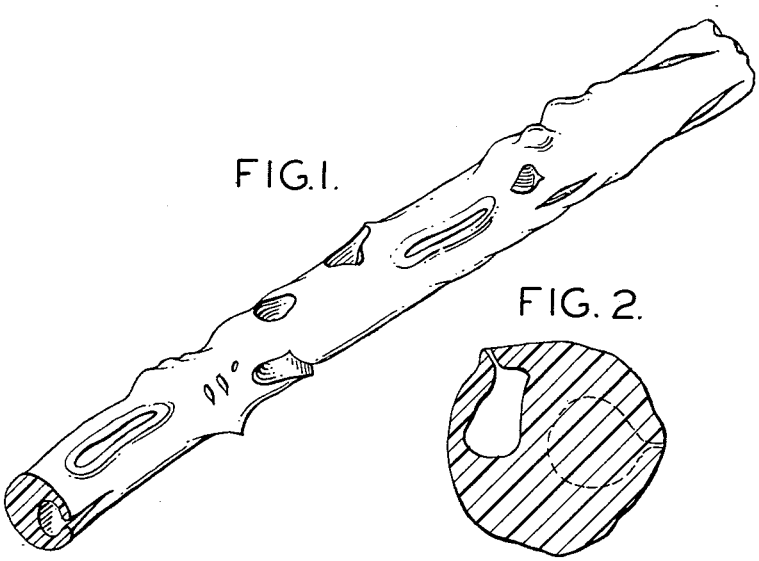
FIG. 2.
FIG. 4a.
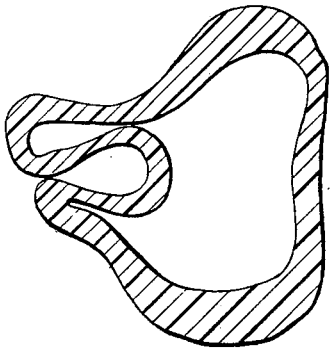
FIG. 3.
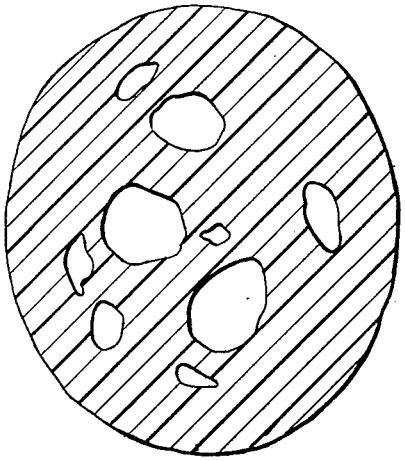
FIG. 4b.
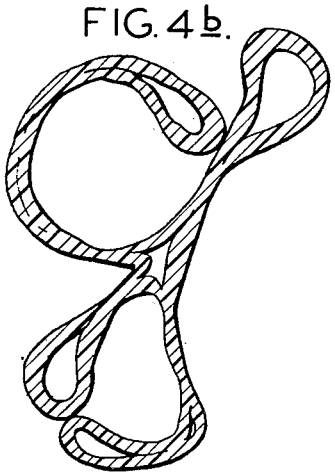
FIG. 5.
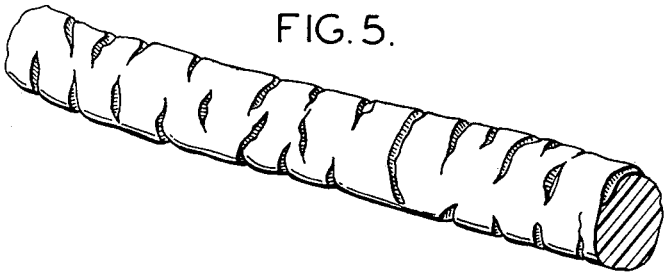
INVENTOR:
ALFRED E. LAUCHENAUER
BY
Howson & Howson
ATTYS.

HIGH TEMPERATURE PROCESS FOR MODIFYING THERMOPLASTIC FILAMENTOUS MATERIAL

Processes for producing porous or spongy fibres from such materials as viscose rayon, acetate rayon, nitrocellulose rayon, cuprammonium rayon, protein fibres and the like to enhance the desirable properties thereof have been known for many years.

More recently attempts have been made to produce porous fibres of thermoplastic material. For example, it has been suggested to incorporate a blowing agent, i.e. an agent giving off a gas when heated to the decomposition temperature in a thermoplastic material, and then extrude the material at elevated temperatures to form filaments. The blowing agent decomposes prior to or during the extrusion process to leave pores or vacuities or open spaces and passages throughout the filaments. Unfortunately such a process has a number of shortcomings which prevented widespread commercial application.

For example, it is difficult to design spinning orifices which can operate over extended periods without clogging or rupture or collapse of the porous filaments formed during the spinning process. The blowing agents decompose prior to or during the spinning operation, to form gas bubbles. Some of these bubbles migrate to the surface of the molten polymer in the extrusion chamber and are lost. Small bubbles tend to merge with larger bubbles in the molten polymer as it is extruded and disrust the flow of material through the spinning orifices, resulting in a break in the spin filaments. Also, the pores in the filaments have a random orientation rather than being arrayed in a predetermined pattern.

It is an object of the present invention to provide a novel method for producing filaments of thermoplastic material having a substantially increased inner surface.

A further object of the invention is to provide means facilitating efficient and speedy treatment of filaments formed of thermoplastic material to markedly enhance desirable properties of such filaments without use of complicated apparatus or procedures.

Another object of this invention is to produce improved thermoplastic filament structures having enhanced heat-insulating properties, increased volume, increased surface area, modified frictional properties, improved absorptive capacity for agents such as dyes, water-repellents, and the like without any serious reduction of the desirable physical properties of the thermoplastic filaments.

A further object of the present invention is to provide a novel method for producing a cracked, notched or nicked surface on thermoplastic filamentous material, i.e. a surface exhibiting more or less regularly arranged indentations.

It has for instance been found that more or less regularly arranged indentations running roughly parallel to the circumference or periphery of the filaments can be obtained in the peripheral portions of thermoplastic filamentous material by subjecting filaments formed of such thermoplastic material for relatively short periods of time to the action of a heating medium maintained at a temperature at least 100°, preferably 150°C. above the glass transition temperature of the thermoplastic material, preferably near or above the softening point of the thermoplastic material for which the filaments are formed, this material preferably being in an at least slightly swollen state when the heat starts to act, by then cooling the heated filamentous material at least superficially and subjecting it to stretching preferably while the surface temperature is substantially lower than the temperature in the inner portions or core of the filaments, the degree of stretching being higher than 5% of the elongation at break. More specifically the process of the present invention also comprises subjecting filaments of thermoplastic material, which preferably contains an pore-forming agent having a swelling action at least at the treating temperature, to a heating medium at a temperature at least 100°C., preferably 150°C. above the glass transition temperature of the thermoplastic material, and preferably near or above its softening point, the temperature of the heating medium and the time of exposure of the filament being such that the peripheral portions of the filaments are affected to a larger degree than the core portions, creating between the core and the periphery temporarily a temperature gradient, the filaments then undergoing a cooling treatment which preferably reverses the temperature gradient, and then stretching the filaments along the fibre axis.

These and other advantages of the present invention will be clear to those skilled in the art in the light of the following disclosure and drawing, in which:

FIG. 1 is a greatly enlarged fragmentary perspective view of nylon 6 filaments having a porous surface produced according to the method of the present invention;

FIG. 2 is an enlarged transverse sectional view thereof;

FIG. 3 is a greatly enlarged transverse sectional view of a porous polyamide filament of the present invention;

FIGS. 4*a* and 4*b* are greatly enlarged transverse sectional views, respectively, of a nylon filament after treatment by the method of the present invention, and FIG. 5 is a greatly enlarged fragmentary perspective view illustrating a nylon filament after treatment by the method of the present invention.

It was discovered that the inner surface of filaments of thermoplastic material could be substantially increased without serious reduction in desirable physical properties of the filaments by subjecting filaments formed of such material and preferably containing a pore-forming agent for relatively short periods of time to a heating medium maintained at a temperature at least 100°, preferably 150°C. above the glass transition temperature of the thermoplastic material, preferably near or above its softening point. More specifically, the process of the present invention comprises subjecting filaments of thermoplastic material containing a pore-forming agent to a heating medium at a temperature at least 100°, preferably 150°C., above the glass transition temperature of the thermoplastic material, preferably near or above its softening point, the temperature of the heating medium and the time of exposure of the filaments thereto being such that the peripheral portions of the filaments are affected by the heat treatment to a substantially larger degree than the core portions, creating within the filaments temporarily a temperature gradient between the core and periphery of the filaments, the temperature at the periphery being sufficient to reduce the intermolecular cohesion of the thermoplastic material at the periphery by at least about 50 percent, and the time of action of heat at the core being substantially lower than at the periphery.

Preferably the filaments of thermoplastic material are subjected to a heating medium maintained at a temperature near to or above the softening point of the thermoplastic material for a period of less than about 5 seconds, the temperature of the heating medium being sufficiently high to cause the thermoplastic material to lose its coherence, orientation or crystallinity throughout its diameter if exposed to such temperature for a period in excess of about 15 seconds.

Various types of filaments of thermoplastic material which can be produced according to this invention are illustrated in the accompanying drawings. For example, the heat treatment of the filaments illustrated in FIG. 1 was moderate to mild resulting in filaments having longitudinally spaced tubular sections formed from spaced pores or voids in the filaments. The polyamide filament shown in FIG. 3 was subjected to somewhat milder treatment than the filaments in FIG. 1, resulting in production of a large number of small pores. The nylon filament illustrated in FIGS. 4a and 4b was exposed for several seconds to temperatures considerably above the melting point of the polymer. Under these relatively severe conditions the pore-forming agent generated pores both in the interior and on the exterior surface of the filament. The nylon filament illustrated in FIG. 5 was first coated with particulate matter such as clay, whiting or other inorganic pigments before being exposed to moderate to mild heating treatments followed by cooling and stretching resulting in filaments having cracks in the peripheral portions of the filaments.

The pores formed in the filaments by the treatment according to the present invention may be left in the form and shape they had immediately after treatment, or their configuration may be changed subsequently for instance by stretching the treated material, which will elongate and compress the pores or vacuities, or by mechanical deformation locally or over the entire length of the filaments, which will flatten the filaments and decrease the volume of the pores.

The porous thermoplastic filaments produced according to this invention have considerably increased volume. Accordingly, they have increased covering power for a given weight and improved heat-insulating capacity due to the voids or pores therein.

Filaments treated in such manner as to have cracks or open pores in the surface or voids in the inner sections of the filaments, as illustrated in the FIGS. 1 to 5 have additional advantages. They are more easily penetrated by liquids such as dye baths, and thus are for instance more easily dyed than untreated filaments. Not only dyes, but also other agents generally used in the treatment of fabrics are more readily absorbed by the porous filaments of this invention.

The voids or pores may be partly or completely filled with liquid or solid textile treating agents, as for example by immersing the treated filaments in dispersions, solutions or emulsions containing liquid or solid agents. Typical treating agents for such purpose include in addition to those mentioned above precondensates, prepolymers or monomers which may be converted in situ into insoluble polyers. If the filaments are immersed immediately after the treatment, i.e. while still hot, in a liquid bath which is relatively cold in comparison to the temperature of the heating medium, the temperature reduction effected thereby will cause a contraction of gas or vapor present in the voids creating a partial vacuum, which will help to draw liquids into the pores. By stretching or mechanically deforming the impregnated filaments, it is possible to some extent to further encapsulate at least partially the absorbed solids or liquids, enabling them to be retained longer and to be released subsequently at a slower rate. As mentioned above, the absorbed agents may be rendered fast to leaching, washing or dry cleaning by polymerization, polycondensation, polyaddition or precipitation in situ.

In the process variation resulting in notched filaments, i.e. in filaments with indentations or cracks on the surface, which is characterized by subjecting the thermoplastic filamentous material for relatively short periods of time to a heating medium maintained at a temperature at least 100°, preferably 150°C., above the glass transition temperature of the thermoplastic material, preferably near or above its softening point, preferably while the filaments contain agents having a swelling action on the thermoplastic material at least at elevated temperatures, particularly at the treating temperature, pigments or pore-forming agents, by cooling said thermoplastic filamentous material at least superficially and then stretching it, which forms an integral part of the present invention. Control of the degree of stretching is particularly important. The elongation obtained should as mentioned above amount to at least 5% of the elongation at break; preferably it is in the range of 10 to 50% of the elongation at break (measured in cold state).

The temperature gradient which is at least temporarily produced by the relatively short contact with the heating medium (the peripheral portions of the filaments having at least temporarily a higher temperature than the core portions), according to this variation of the process according to the present invention, will be at least temporarily reversed during the cooling treatment and this reversed gradient, where the peripheral portions of the filaments have a lower temperature than the core portions, preferably also exists during stretching. It is thus important to carry out the cooling treatment in this case almost immediately or immediately after the heat treatment in order to "freeze in" the configuration of the peripheral portions of the filaments produced by subjecting the filaments to the heating media and in order to create a strong reversed temperature gradient. It is advisable to carry out the stretching treatment immediately after or during the cooling step. The most advantageous method of carrying out the process will in fact be a continuous treatment consisting of the heating, cooling and the stretching steps.

The filaments during the contact with the heating medium may contain swelling agents having a swelling action at least at or near the temperature of the heating medium, including what is called a "carrier" and is used to facilitate and speed up the diffusion of dispersed dyestuff into thermoplastic fibres, particulate matter such as particles of clay, whiting and similar inorganic matter deposited on the surface of the filaments, finishing agents such as colored pigments, dyestuffs, polymeric compounds. Such particulate matter has also been found useful in minimizing the fusing together of fibres during the heat treatment.

Cooling of the filaments may be effected by contact with gases or with liquid or solid media having a temperature substantially lower than the heating medium, i.e. for example by blowing cold air against the hot filaments, by immersing them into liquids such as for instance water, which liquids may contain salts or other compounds producing ions when dissolved, known finishing agents such as those mentioned above etc., or by contact with solid bodies such as rollers (single or in pairs).

To create a reversed temperature gradient as high as possible, one will keep the cooling agent at a temperature near or below room temperature.

Stretching may be carried out by known, i.e. conventional methods either after, prior to or during the evaporation of liquids if liquid cooling agents are used. The degree of stretching should be higher than 5 percent, preferably 10 percent or more of the elongation at break (measured at room temperature).

The filamentous material may be caused to react during or after the heat treatment with chemical agents, i.e. to form convalent bonds between macromolecular chains and such agents, or between adjacent macromolecules and molecules of the agent if the latter is bi- or polyfunctional. The chemical agents may be present in the filamentous material before the heat treatment begins, or they may be present in the heat transfer agent in a dissolved state or as solid particles, or the agents may be applied in molten form or as vapors. Catalysts for such reactions may be applied simultaneously or at another state. It has been found that (a) such reactions, which may consist in substitution, grafting or crosslinking reactions of the macromolecules of the filamentous material and which may involve one, two or more components in addition to said materials as well as reaction catalysts, proceed at much higher speed if carried out at the treating temperature during the heat treatment, that (b) the plastic state in which at least the peripheral portions of the filamentous material are during the treatment greatly facilitate the reaction, that (c) due to the exceptionally high temperatures at which the reaction takes place, reactions with reagents can be obtained which under conventional conditions did not react to any appreciable degree and that (d) this method enables to obtain if desired reactions only at in certain areas of the filamentous material, such as for instance the peripheral portions. This may be desirable if the purpose of the chemical modification is for instance to achieve more hydrophilic properties, better dyeability, better soil release properties on the surface, or a change of the glass transition temperature of the degree of crystallinity etc., of the thermoplastic fibres in the surface portions; generally speaking whenever the purpose is a modification of surface properties of the filaments while virtually retaining unchanged physical and chemical properties of the other, in particular the interior portions of the filaments.

The term "glass transition temperature" as used throughout this specification means "the temperature at which the specific volume/temperature curve (when measurements are carried out slowly) changes slope" (M.L. Miller, The Structures of Polymers, Reinhold Publishing Corp., 1966, page 281).

The term "total surface area" means the surface area inside and outside of a fibre which is accessible at least to gaseous and liquid agents of low molecular weight, in particular to water, and which thus is available for interaction with agents having a swelling action on the fibre material. Filamentous material produced according to the present invention will have an inner surface at least 3 times larger than the surface area of the same material as determined by multiplying the area within the circumference of a filament with its length.

By "softening point" is meant the temperature at which a filament of thermoplastic material is elongated irreversibly for more than 10 percent if subjected to a stretching stress of one gram per denier. By "near to the softening point" or "near to the melting point" is meant a temperature within about 10°C. of the softening or melting point of the thermoplastic material.

The range of temperatures of the heating medium to which the filamentous material is exposed, has a lower limit a temperature of at least 100°, preferably 150°C. above the glass transition temperature of the thermoplastic material, preferably near or above its softening point of the thermoplastic material of which the filaments are composed. There is no upper temperature limit for the heating medium which can be expressed in degrees C, since at extremely short exposure times extremely high temperatures may be used (even temperatures higher than the melting point of the fibre material), while at lower temperatures the exposure time must be increased. The maximum exposure time found to give satisfactory results is as a rule not more than about 15 seconds. A maximum exposure of 5 seconds is preferably where the temperature of the heating medium is above the softening point of the thermoplastic material.

At very high temperatures of the heating medium (for instance near to or higher than the melting point of the thermoplastic material) treating times may be one second or less. If, however, the rate of action is controlled by a diffusion mechanism, one may work under conditions where the treating time is longer than 15 seconds, but less than one minute, preferably 30 seconds at most. Because the temperature of the heating medium may be above the softening point of the thermoplastic material of which the filaments are formed, the filaments would lose their orientation and/or crystallinity or even their entire strength if exposed to the heating medium for extended periods of time, e.g. periods of time in excess of 15 seconds at moderate temperatures and even shorter periods of time at extremely high temperatures.

More specifically, the temperature of the heating medium ordinarily will be such that the filaments would lose more than 85 percent of their tensile strength (measured under the same conditions) if exposed to the heating medium for a minute or more, and would be degraded by the action of the heat to the extent that an irreversible strength loss of at least 25 percent (measured at room temperature) would take place if the filaments were subjected for a prolonged time to these conditions.

Since the exposure of the filamentous material to heat is relatively short, and since agents such as for instance pore-forming agents present may be liquids or solids or gases which evaporate, sublime or permeate during the heat treatment, consuming heat by evaporation or subliming, a temperature gradient will develope in a radial direction over the cross-section of the filaments, i.e. the action of the heat on the peripheral portions will take place for a longer period, as compared to the core portions, and thus the heat will have a greater influence on intermolecular cohesion at the periphery than in the core. If the agents present in the thermoplastic material of which the filaments are formed evaporate, sublime or permeate during the heat treatment, the evaporation or sublimation proceeds from the surface of the filaments to the core, resulting in the formation of both interconnected and non-interconnected pores in or near the core of the filaments (see for example FIG. 3). This is surprising since it would be expected that evaporation, sublimation or permeation of the pore-forming agent would take place preferentially near the periphery of the filaments during the heat treatment. Factors affecting internal pore formation include the diameter of the filaments, the heat capacity and molecular porosity of the thermoplastic material, the heat of evaporation, sublimation or permeation of the pore-forming agent, and degree of uniformity of heat treatment.

Agents applied to the fibre material prior to or during the heat treatment will be selected in a way that they do not per se degrade the material under the conditions of the treatment. They all are non-solvents for the fibre material in question and will not cause chemical degradation to any substantial degree under the treating conditions.

The term "pore-forming agents" as used throughout this specification denotes agents which under the treating conditions are capable of reducing the intermolecular cohesion of the polymeric thermoplastic material. They have a swelling action at least at the temperature of the treatment. Their boiling or decomposition point may be lower than the treating temperature, in which case these agents will be present within the heated filaments in an expanded gaseous state. In order to control the release of such agents into the fibre material (from the periphery towards to core) one may apply to the fibre material prior to the heat treatment particulate matter capable of absorbing pore-forming agents having a boiling point lower than the treating temperature.

The shock-like action of the heat causes the pore-forming agents to evaporate, sublime, permeate and/or decompose at a very fast rate, which is a major factor in the formation of vacuities inside the filaments. In addition, relatively high pressures may build up in and around the core, which can result in the formation of vacuities in the core area. If the heat transfer is not uniform over the periphery and cross-section, more asymetrical vacuities will develop.

Agents have been successfully used which have a boiling or decomposition point higher than the treating temperature. These too are agents capable of reducing the intermolecular cohesion of the polymeric thermoplastic fibre material at least at the temperature of the treatment. Such high-boiling pore-forming agents as a rule will favor the formation of surface pores and vacuities, i.e. vacuities open to the fibre surface.

Filaments which are elongated or drawn, i.e. oriented along their axes during or after spinning are anisotropic both in respect to the transfer of heat and to the migration of penetration of pore-forming agents, vapors and gases inside the oriented polymer material. The vacuities formed in such elongated filaments thus tend to have oblong shapes such as ovals, tubes, etc., where the longer axis runs parallel to the axis of the filaments.

Since, as noted, the action of the heat is for a relatively short period, thus a radial temperature gradient in the filaments develops, which gradient will in most instances exceed 150°C. at the moment the material is exposed to the heating medium, this temperature difference being the difference between the temperature at the core, as compared to the periphery of the filaments. It is important that the rate of heat transfer from the heating medium to the surface of the filaments be as high as possible, i.e. that the surface of the filaments reach a temperature approaching that of the heating medium as soon as possible. It is also important that heat transfer inside the filaments take place at a considerably slower rate. Under these conditions, the temperature and/or the actual time during which any particular part of the filamentous material is exposed to such heat, will vary radially over the cross-section of the filaments, decreasing from the periphery to the core if the heat is symmetrical, i.e. uniform over the periphery of filaments of circular cross-section. The temperature reached, and/or the time this temperature is effective on the material, thus will be higher in the peripheral portions, which are in fact subjected to conditions as to temperature and time of exposure which reduce their intermolecular cohesion and/or crystallinity, at least momentarily, i.e. during the action of the heat, to point where the tensile strength of the material, if measured under the same conditions would be reduced by at least 50 percent and preferably by at least 80 percent.

The heat treatment in the process of the present invention thus may be described as such (temperature and duration of heating) as to cause the intermolecular cohesion (crystallinity) of the peripheral portions of the filaments to drop, at least temporarily, by at least 50 percent. The action of the heat treatment at the core of the filaments is substantially lower than at the periphery.

Evaporation, sublimation and/or permeation of the pore-forming agent may involve mechanisms which consume heat and thereby assist in maintaining the above described temperature differential within the filaments.

The pore-forming agent used according to the invention may be gaseous materials such as air, Freon, nitrogen, ammonia, carbon dioxide and the like; volatile liquids which are nonsolvents for the particular thermoplastic material forming the filaments, monomers or oligomers of the particular thermoplastic material forming the filaments and other organic and inorganic compounds having a boiling point or decomposition point below or above the temperature of the heating medium.

The amount of pore-forming agent used depends to a large degree upon the nature of the thermoplastic material and pore-forming agents used. In general a pore-forming agent, in liquid, or solid form, may be incorporated into the thermoplastic material in amounts ranging from about 0.1 to about 20 parts by weight based on the total weight of the thermoplastic material. The preferred range is from about 0.5 to about 10 parts by weight.

In the case of gaseous pore-forming agents absorbed or adsorbed by the thermoplastic material, they should be present to the extent of from about 0.01 to about 10 parts by weight based on the total weight of thermoplastic material.

Heating of the filaments to cause pore formation or cracks in the surface portions can be effected in various ways using different heating mediums such as gases, liquids, solids, microwave, laser and infra red means. Preferred methods produce rapid, controlled heating of the filaments. The method selected will also depend upon the form in which the filaments are presented to the heating medium, i.e. whether the filaments are heated in the form of single filaments, yarns, woven or knitted fabrics, or non-woven textile sheet material, the preferred method, as noted, producing rapid uniform heating of the filaments under controlled conditions.

Suitable liquid heating mediums include substantially chemically inert, relatively high boiling organic liquids, such as silicone oils having a boiling point substantially above the melting point of the thermoplastic material of which the filaments are composed. Metals and metal alloys of relatively low melting point may also be used as a liquid heating medium. Eutectic metal alloys such as those composed of cadmium, antimony and lead provide very good heating medium baths. Similarly, lead, tin, cadmium and similar alloys, such as bismuth, tin, lead alloys form suitable metal bath compositions.

A gaseous heating medium is particularly suitable, provided substantial uniformity of heating is produced thereby. This can for instance be accomplished by using the vapor of a relatively high boiling liquid and carrying out the process at the boiling point of the liquid. The liquid may be selected so that its vapor produces special effects on the filaments, including swelling of the filaments or chemical reactions therewith.

Solid particles, such as sand, small diameter glass spheres, salt crystals, and particles of organic material having a softening point above the treating temperature, e.g. finely divided phenolic resins may be used effectively as a fluid bed heating medium for individual filaments and relatively simple filamentary structures. Where groups of filaments are treated, the particle size of the solid particles should be somewhat less than the interstices between the filaments.

Heating of the filaments can also be effected by infra red means, lasers or high frequency waves.

If the heat treatment is to be effected only on selected portions of filaments, yarns or textile sheet material, or only on one side of textile sheet material, the above described heating methods may be used, with appropriate modifications as necessary to obtain the desired effect. The heat treatment, if desired, may be repeated under the same or different conditions as to agents present, temperature, time of exposure, heating medium, etc. Before or after the heat treatment the filaments may be cooled to obtain a greater temperature gradient, or may be preheated over their entirety or in selected portions, to reduce the gradient or to convert solid agents present to liquids, or liquids into vapors, prior to the actual heat treatment.

The filaments may be treated in the form of single filaments or fibres, as yarns, as oriented bundles or webs of filaments or fibres, and as knitted, woven or non-woven fabrics. Instead of treating thermoplastic polymers in the form of filamentous material according to the present invention, one may subject films of the same thermoplastic polymers to the same treatment.

Fabrics may be subjected to the method of this invention at any desirable state of finishing, as for example in grey state, or before or after dyeing, heatsetting or texturizing, or during or after treatment involving mechanical deformation of individual fibres or yarns, or fabrics, but preferably before finishing agents such as softeners and agents influencing the absorption of moisture, oil, aqueous stains, or particulate dirt, are applied.

The filamentous material may be subjected to longitudinal stress before, during or after the heat treatment according to the present invention.

The filaments of thermoplastic material may consist of or contain polyesters, such as polymeric esters of di- or polyhydroxy compounds with di- or polycarboxylic acids, or polyamides, as for example those produced by reacting di- or polyamines with di- or polycarboxylic acids or by polymerizing lactams of polyurethanes, polycarbonates, and polyolefins, of polymers or copolymers of acrylic or vinylic compounds, such as acrylonitrile, vinyl chloride, vinyl acetate, vinyl alcohol, acrylic esters; including block and graft polymers, bicomponent fibres or blends of fibres.

EXAMPLE 1

A monofil nylon 6 filament (diameter 0.17 mm), which had not been drawn previously and which contained 3.5% water, was subjected to a heat treatment by immersing it for one second into triethylene glycol heated to 210°C. Cooling was effected by contact with water (room temperature) immediately after the heat treatment. After cooling, the filament was stretched by 10 to 20%.

The filament thus treated showed virtually regular indentations on its surface, these indentations running more or less parallel to the circumference of the fibre.

EXAMPLE 2

A nylon 6 filament (300 dtex, monofil, not drawn previously) was immersed in water (20°C.) for 1 hour and then subjected without drying to a high temperature heat treatment by leading the filament through a fluid bed of sand (sand particles kept suspended in a vessel by hot air blown through the bottom of the vessel). The temperature measured in the fluid bed close to the filament was 205°C., the time during which the filament was exposed to this temperature being 22 seconds. Cooling: Contact with air (room temperature). The filament thus treated showed infrequent vacuities in its interior. Its specific gravity (determined by immersion in salt solutions of different concentrations for 15 minutes at 20°C., the specific gravity of the filament being equal to that of the salt solution in which the filament floats without sinking nor rising to the surface) was 1.125 against 1.133 for the untreated material.

The degree of polymerization was not changed by the heat treatment.

EXAMPLE 3

The same filament as in Example 2 was immersed into an aqueous solution of polyethylene glycol (20% by weight, degree of polymerization 6000) at 20°C. for 1 hour before being treated exactly as described in Example 2.

The filament exhibited numerous vacuities in its interior and some pores on its surface. The density of the filament (determined as described in Example 2) was found to be 1.110 (untreated material: 1.133).

The degree of polymerization was found to be unchanged after the heat treatment.

The treated filament together with an untreated one was dyed with a metallized acid dyestuff (Irgalan blue, RL, acid Blue 240) as follows: Bath ratio 1:40 10% dyestuff (on weight of fibre material) in the bath, which also contained 0.5 grams per liter ammonium acetate, 0.2 grams per liter wetting agent (non-ionic), the pH of the bath being 8.5.

The temperature of the dye bath was raised within one hour from 40°C. to the boil, and kept at the boiling point for another hour. The fibre material then was rinsed hot and cold and soaped off in a bath containing 2 grams/liter detergent.

Cross sections of the treated filamentous material after dyeing showed complete penetration of the dyestuff throughout the cross section, while in the case of the untreated filaments only a thin surface layer was dyed. Dyestuff take-up for the treated sample was about 3.5 times higher than for the control.

EXAMPLE 4

The same filament as in Example 2 was immersed in an aqueous solution of dimethyl sulfoxide at 20°C. for 1 hour before being heat treated exactly as described in Example 2.

The filament thus treated exhibited numerous vacuities in its interior.

The density of the treated filament was 1.110, the iodine absorption number (determined according to Schwertassek et al., Faserforschung and Texiltechnik 10 (1959), p. 472) was 141.7 against 122.5 for the untreated, but heat-set material.

The treated filament was found to take up 40% more liquid (10% aqueous solution of $MgCl_2$) than the untreated, but heat-set material.

EXAMPLE 5

A multifil nylon 6 yarn (35 fibrils, 230 dtex, predrawn) was swollen in an aqueous solution of polyethylene glycol (5% by weight, temperature 20°C., degree of polymerization 6000) for 20 seconds before being subjected to the same treatment as in Example 2.

Individual fibrils thus treated exhibited numerous small vacuities in their interior.

EXAMPLE 6

The same yarn as in Example 5 was given the treatment described in Example 5, the only difference being that the contact with the polyethylene glycol solution prior to the heat treatment lasted 10 minutes and that the molecular weight of the polyethylene glycol was 200.

The fibrils exhibited vacuities with pores extending to the surface.

EXAMPLE 7

A nylon 6.6 monofilament (not drawn previously) was conditioned in an atmosphere of 65% relative humidity at 20°C. for 12 hours prior to being heat-treated for 2.4 seconds at 255°C. (Infrared heat, temperature of surrounding air). The filament thus treated showed vacuities in its interior.

EXAMPLE 8

A nylon 6.6 monofilament (pre-drawn, 16.4 dtex) was immersed in ethanol at 20°C. for 5 minutes and then subjected to a heat treatment for 2 seconds in the vapor of cetyl alcohol (boiling point 301°C). After cooling, the filament was washed. It showed small vacuities in its core.

EXAMPLE 9

A nylon 6.6 monofilament (16.4 dtex, pre-drawn) was cooled to −60°C. (solid carbon dioxide) prior to being heat-treated at 257°C. for 0.3 seconds by immersion in paraffine oil heated to that temperature. After cooling, the filament was found to have small vacuities in its core.

EXAMPLE 10

A polyester monofilament (ethylene terephtalate, 20 tex, not drawn previously) was first immersed in concentrated hydrochloric acid (32% strength) for 10 seconds at 20°C., and then heat treated for 3 seconds in a fluid bed (sand particles) having a temperature of 245°C. The filament after cooling was found to have a relatively small number of vacuities in its core.

What is claimed is:

1. Process for substantially increasing the total surface area of filaments of a thermoplastic polymer having an oriented crystalline structure by forming therein vacuities which are at least microscopically visible, and/or voids, indentations or cracks on the surfaces of said filaments which comprises:

1. contacting said filaments with a pore-forming or void-forming agent to incorporate therein from about 0.1 to about 20%, by weight, of said filaments, of said pre-forming or void-forming agent;
2. subjecting said filaments for a period of less than about 15 seconds and in the absence of longitudinal stress to a heating medium which is at a temperature of at least 100°C. above the glass transition temperature of said polymer, the temperature of said heating medium being such that the polymer would lose more than 85%, of its tensile strength if said filaments were subjected thereto for a period of more than about one minute, the temperature and time of exposure to said heating medium being such that the peripheral portions of the filaments are affected to a larger degree than the inner portions, thereby creating between the periphery and the inner portions a temperature gradient, and
3. immediately cooling said filaments by subjecting them to a cooling medium, said cooling reversing said temperature gradient, said pore-forming or void-forming agent comprising a liquid composition capable of being volatilized at least partially at the temperature to which said filaments are heated by said heating medium and being a non-solvent for said polymer but having a swelling action for said polymer at least at the temperature to which said filaments are heated by said heating medium and will not cause chemical degradation of the polymer to any substantial degree.

2. The process according to claim 1 in which said filaments are stretched to at least 5% of elongation at break.

3. The process according to claim 1 in which the voids formed in said filaments during said heat treatment are filled with a finishing agent by immersing the filaments while hot in a cooling liquid containing said finishing agent.

4. The process according to claim 1 in which said filaments are cooled to a temperature below room temperature prior to said heat treatment.

5. The process according to claim 1 in which said filaments are introduced to a cooling medium which is at a temperature below room temperature subsequent to said heat treatment.

6. The process according to claim 1 wherein said filaments are in the form of yarn, or woven, non-woven or knitted textile sheet material.

7. A process according to claim 1 in which said heating medium is at a temperature of at least about 150°C. above the glass transition temperature of said polymer.

8. A process according to claim 1 wherein said heating medium comprises gas or vapor.

9. The process according to claim 1 in which said heating medium comprises a fluidized bed of finely divided solid particles.

10. The process according to claim 1 in which said heating medium comprises a liquid heated to a temperature below its boiling point.

11. A process according to claim 1 in which said cooling medium comprises a gas or vapor.

12. The process according to claim 1 in which said pore-forming agent is a liquid having a boiling point below the temperature of the heating medium.

13. The process according to claim 12 in which said pore-forming agent is water.

14. The process according to claim 1 in which said filaments are subjected to longitudinal stress after being cooled.

15. The process according to claim 1 in which filaments after cooling are subjected to longitudinal stress such that the filaments are stretched to from 10 to 50% of the elongation at break.

16. The process according to claim 1 in which the heating medium is at a temperature within about 10°C. of the softening point of the polymer.

* * * * *